US010053862B2

(12) United States Patent
Baik

(10) Patent No.: US 10,053,862 B2
(45) Date of Patent: Aug. 21, 2018

(54) CONTAINER MODULE FOR CONSTRUCTION HAVING FIREPROOF FLOOR SLAB AND STRUCTURE INCLUDING THE SAME

(71) Applicant: URBANTAINER CO., LTD., Seoul (KR)

(72) Inventor: Jiwon Baik, Seoul (KR)

(73) Assignee: URBANTAINER CO., LTD., Seoul (KR)

( * ) Notice: Subject to any disclaimer, the term of this patent is extended or adjusted under 35 U.S.C. 154(b) by 99 days.

(21) Appl. No.: 15/007,901

(22) Filed: Jan. 27, 2016

(65) Prior Publication Data

US 2016/0222649 A1 Aug. 4, 2016

(30) Foreign Application Priority Data

Jan. 29, 2015 (KR) ..... 10-2015-0014192

(51) Int. Cl.

| | |
|---|---|
| ***E04B 1/348*** | (2006.01) |
| ***E04C 5/00*** | (2006.01) |
| ***E04H 1/00*** | (2006.01) |
| ***B65D 90/02*** | (2006.01) |
| ***B65D 90/22*** | (2006.01) |
| *E04H 1/12* | (2006.01) |

(52) U.S. Cl.

CPC ..... *E04C 5/00* (2013.01); *B65D 90/02* (2013.01); *B65D 90/22* (2013.01); *E04B 1/3483* (2013.01); *E04H 1/005* (2013.01); *E04H 2001/1283* (2013.01)

(58) Field of Classification Search

CPC ..... E04H 1/005; E04H 2001/1283
USPC ..... 52/79.9–79.14, 236.5, 236.8, 414
See application file for complete search history.

(56) References Cited

U.S. PATENT DOCUMENTS 508,502 A * 11/1893 Crittenden ..... E04B 5/29 52/336
3,484,999 A * 12/1969 Van Der Lely ..... E04B 1/34815 52/405.3
4,077,170 A * 3/1978 van der Lely ..... E04B 1/34853 52/263
4,545,158 A * 10/1985 Rizk ..... E04B 1/3483 52/238.1

(Continued)

FOREIGN PATENT DOCUMENTS

JP 06146433 A * 5/1994
KR 1019980058170 A 9/1998

(Continued)

*Primary Examiner* — Robert Canfield
(74) *Attorney, Agent, or Firm* — Fox Rothschild LLP

(57) ABSTRACT

Disclosed is a container module for construction having a fireproof floor slab. The container module for construction having a fireproof floor slab may include: two lower side rails that constitute lower long sides among lower sides of the container module for construction; two lower end rails that constitute lower short sides among the lower sides; four lower corner castings respectively arranged at corners between the lower sides; supporting units respectively provided to be inwardly protruded from inner surfaces of the two lower side rails; and a slab part of which both ends are supported by supporting surfaces of the supporting units respectively provided at the two lower side rails.

14 Claims, 8 Drawing Sheets

(56) References Cited

U.S. PATENT DOCUMENTS 4,545,159 A * 10/1985 Rizk ..... E04B 1/3483 52/143
4,599,829 A * 7/1986 DiMartino, Sr. ..... E04B 1/3483 410/79
4,613,053 A * 9/1986 Kimura ..... B65D 88/121 105/359
4,620,404 A * 11/1986 Rizk ..... E04B 1/3483 52/235
4,833,841 A * 5/1989 Ellington, III ..... E04B 1/3483 52/143
5,113,625 A * 5/1992 Davis ..... E04B 1/34336 52/143
5,450,977 A * 9/1995 Moe ..... B65D 88/022 220/1.5
6,038,824 A * 3/2000 Hamrick, Sr. ..... E04B 1/34336 52/125.2
6,675,540 B1 * 1/2004 Rokes ..... E04B 1/34336 220/1.5
7,353,960 B2 * 4/2008 Seiter ..... B61D 17/18 105/355
9,233,694 B2 * 1/2016 Kato ..... B61D 17/10
9,556,612 B2 * 1/2017 Bottin ..... E04C 3/07
2005/0210762 A1 * 9/2005 Broberg ..... E04B 1/34807 52/79.1
2007/0000921 A1 * 1/2007 Butler ..... B65D 88/121 220/1.5
2007/0271857 A1 * 11/2007 Heather ..... B65D 88/005 52/79.9
2008/0134589 A1 * 6/2008 Abrams ..... E04B 1/003 52/79.1
2009/0307994 A1 * 12/2009 Cathcart ..... E04B 1/3483 52/79.9
2010/0024331 A1 * 2/2010 Stiffler ..... E04B 5/10 52/236.8
2011/0252719 A1 * 10/2011 Wallance ..... E04B 1/003 52/79.5
2014/0083321 A1 * 3/2014 Kato ..... B61D 17/10 105/413
2014/0298745 A1 * 10/2014 Rechenmacher ..... E04B 1/161 52/425
2015/0007506 A1 * 1/2015 Wallance ..... E04B 1/003 52/79.9
2015/0014886 A1 * 1/2015 Mullaney ..... E04B 1/3431 264/299
2016/0017609 A1 * 1/2016 Bottin ..... E04D 13/04 52/302.1

FOREIGN PATENT DOCUMENTS

KR 200311206 Y1 4/2003
KR 1020040076516 A 9/2004
KR 1020090064989 A 6/2009
KR 1020120070400 A 6/2012
KR 1020130034385 A 4/2013
KR 1020140133404 A 11/2014

* cited by examiner

CONTAINER MODULE FOR CONSTRUCTION HAVING FIREPROOF FLOOR SLAB AND STRUCTURE INCLUDING THE SAME

CROSS-REFERENCE TO RELATED APPLICATION

This application claims the benefit under 35 USC 119(a) of Korean Patent Application No. 10-2015-0014192 filed on Jan. 29, 2015, in the Korean Intellectual Property Office, the entire disclosures of which are incorporated herein by reference for all purposes.

TECHNICAL FIELD

The present disclosure relates to a container module for construction having a fireproof floor slab and a structure including the same.

BACKGROUND

In recent years, the number of cases of constructing structures using containers such as shipping containers has been increasing. In this regard, Korean Patent Laid-open Publication No. 2012-0070400 discloses a modulation method in the groundwork for container construction.

Meanwhile, referring to Article 56 of the Enforcement Decree of the Korean Building Act (as partially revised on Nov. 28, 2014), when a structure with three or more floors or a structure with a predetermined total floor area or more is constructed, it is obligatory to prepare a fireproof construction for securing safety in case of fire and obtain approval. As such, a structure with a predetermined size or more can be constructed only when satisfying the requirements for fireproof construction.

However, when a structure is constructed by modularizing a container, since a structural design scheme for obtaining approval for fireproof construction has not yet been clearly established, there are limitations for a container module to be used for constructing a structure with a predetermined size or more.

SUMMARY

In view of the foregoing, the present disclosure provides a container module for construction having a fireproof floor slab and a structure including the same, capable of securing a spacious inner room with a fireproof construction optimized and designed for the container module, satisfying the requirements for fireproof construction of a structure, and also securing high constructability.

In accordance with a first exemplary embodiment of the present disclosure, a container module for construction having a fireproof floor slab may include: two lower side rails that constitute lower long sides among lower sides of the container module for construction; two lower end rails that constitute lower short sides among the lower sides; four lower corner castings respectively arranged at corners between the lower sides; supporting units respectively provided to be inwardly protruded from inner surfaces of the two lower side rails; and a slab part of which both ends are supported by supporting surfaces of the supporting units respectively provided at the two lower side rails.

In accordance with a second exemplary embodiment of the present disclosure, a structure may include a container module for construction having a fireproof floor slab in accordance with the first exemplary embodiment of the present disclosure.

According to the above-described exemplary embodiments of the present disclosure, since the slab part is provided to be supported by the supporting units respectively provided at the inner surfaces of the lower side rails, the slab part can be arranged to use an inner space surrounded by the lower side rails and the lower end rails without reducing an inner room of the container module as much as possible. Therefore, the present container module for construction makes it possible to easily obtain fireproof efficiency satisfying the fireproof standards without additional work for obtaining fireproof certification in a construction site.

That is, according to the above-described exemplary embodiments of the present disclosure, a fireproof construction designed to be customized for a frame of a container module makes it possible to maximize application of the inner room of the container module and also possible to satisfy the requirements for fireproof construction.

Further, as described above, since the slab part is formed in the space inside the lower rails, the lower rails can be used as side casts for placing and curing concrete. Therefore, it is possible to minimize the use of a separate cast and thus possible to secure high constructability.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1:
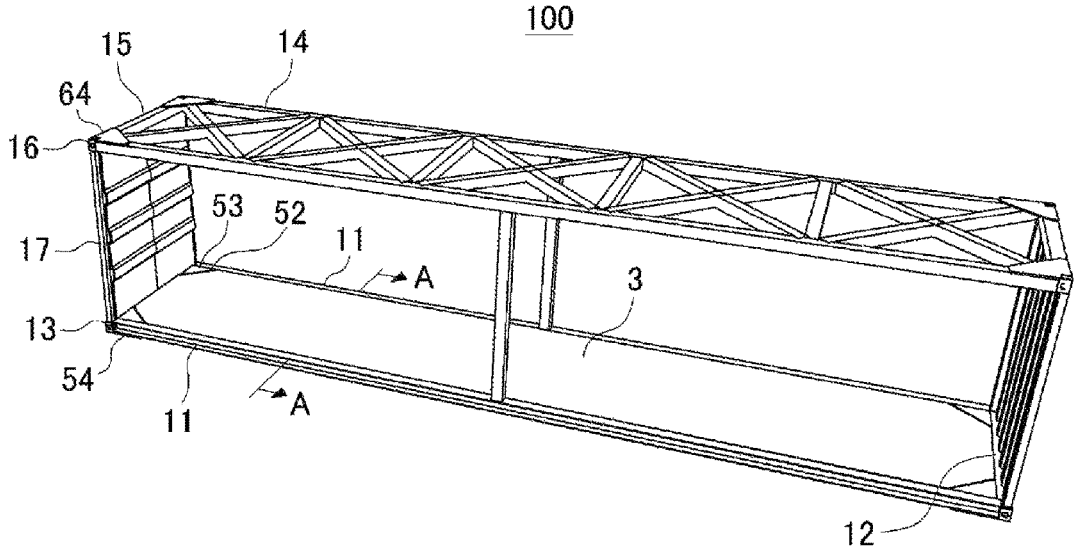
FIG. 1 is a schematic three-dimensional diagram of a container module for construction having a fireproof floor slab in accordance with an example of the present disclosure.

Hereinafter, example embodiments will be described in detail so that inventive concept may be readily implemented by those skilled in the art. However, it is to be noted that the present disclosure is not limited to the example embodiments and examples but can be realized in various other ways. In drawings, parts not directly relevant to the description are omitted to enhance the clarity of the drawings, and like reference numerals denote like parts through the whole document.

Through the whole document, the terms "connected to" or "coupled to" are used to designate a connection or coupling of one element to another element and include both a case where an element is "directly connected or coupled to" another element and a case where an element is "indirectly or electronically connected or coupled to" another element via still another element.

Through the whole document, the term "on" that is used to designate a position of one element with respect to another element includes both a case that the one element is adjacent to the another element and a case that any other element exists between these two elements.

Further, through the whole document, the term "comprises or includes" and/or "comprising or including" used in the document means that one or more other components, steps, operation and/or existence or addition of elements are not excluded in addition to the described components, steps, operation and/or elements unless context dictates otherwise. The term "about or approximately" or "substantially" are intended to have meanings close to numerical values or ranges specified with an allowable error and intended to prevent accurate or absolute numerical values disclosed for understanding of the present disclosure from being illegally or unfairly used by any unconscionable third party. Through the whole document, the term "step of" does not mean "step for".

Hereinafter, a container module for construction having a fireproof floor slab in accordance with an example of the present disclosure (hereinafter, referred to as "present container module for construction 100") will be described.

Figure 2:
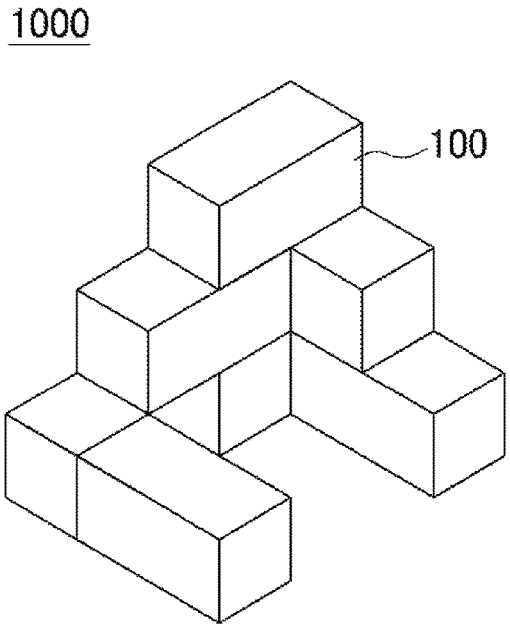
FIG. 2 is a conceptual diagram of a structure in accordance with an example of the present disclosure.

FIG. 1 is a schematic three-dimensional diagram of a container module for construction having a fireproof floor slab in accordance with an example of the present disclosure, and FIG. 2 is a conceptual diagram of a structure in accordance with an example of the present disclosure.

Referring to FIG. 1 and FIG. 2, the present container module for construction 100 may be used, such as being stacked into two or more levels or horizontally arranged in various ways, for constructing a structure 1000.

In an example, a two-story structure may be formed by arranging two present container modules for construction 100 to be orthogonal to each other in a L-shape on the ground and stacking two present container modules for construction 100 thereon. In another example, a structure including three rooms on the first floor and two rooms on the second floor may be formed by arranging three present container modules for construction 100 in a U-shape and stacking two present container modules for construction 100 thereon. In yet another example, as illustrated in FIG. 2, four present container modules for construction 100 may be arranged in a U-shape on the first floor, two present container modules for construction 100 may be arranged in a L-shape on the second floor, and one present container module for construction 100 may be arranged on the third floor.

As such, the structure 1000 may be constructed in various ways by combining and arranging the multiple present container modules for construction 100 in a horizontal direction and a vertical direction.

For reference, in the present container module for construction 100, the term "for construction" does not mean to limit the application of the present disclosure simply to the construction field. For example, the present container module for construction 100 can be applied not only to building structures but also various structures including civil engineering structures, plant structures, and other structures. Further, the term "structure" used in the present disclosure may be understood in a broad sense as including civil engineering structures, plant structures, and other structures.

Figure 3A:
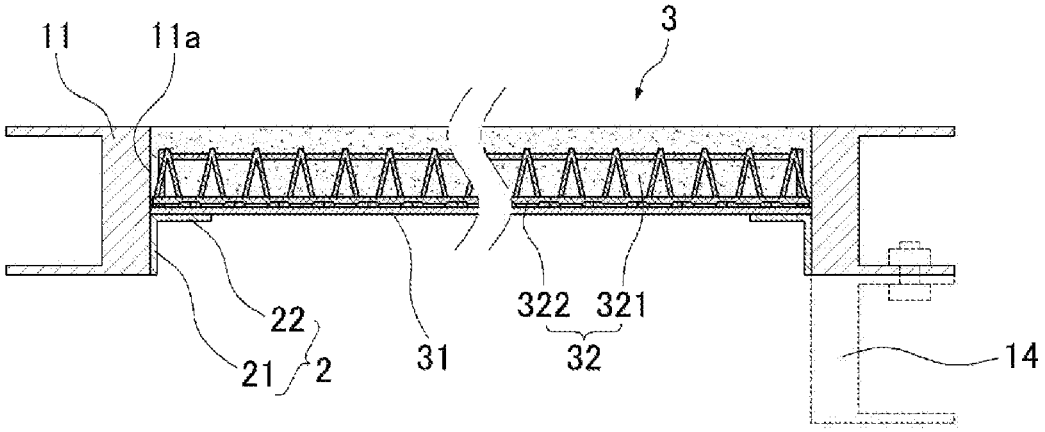
FIG. 3A is a schematic cross-sectional view taken along a line A-A of FIG. 1.
Figure 3B:
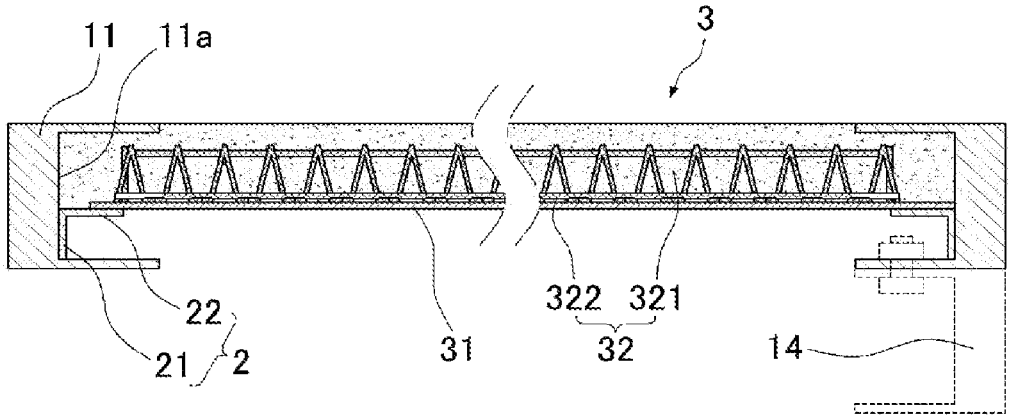
FIG. 3B and FIG. 3C are cross-sectional views provided to describe another exemplary embodiment of lower side rails.
Figure 3C:
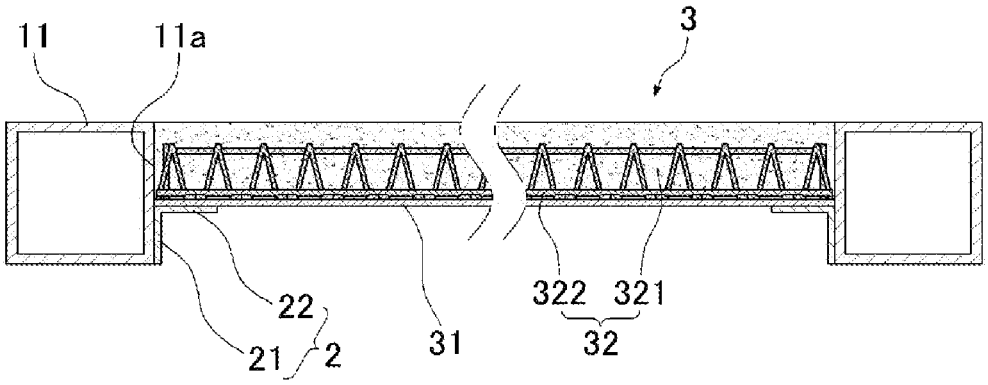
Figure 4A:
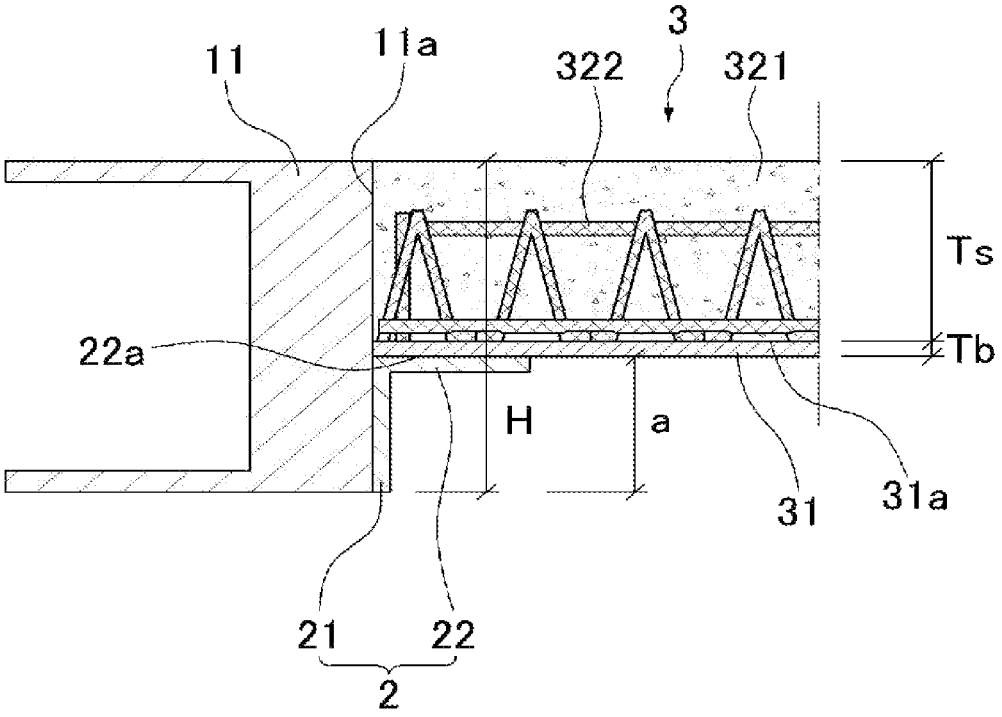
FIG. 4A is an enlarged conceptual diagram of a portion of FIG. 3A.
Figure 4B:
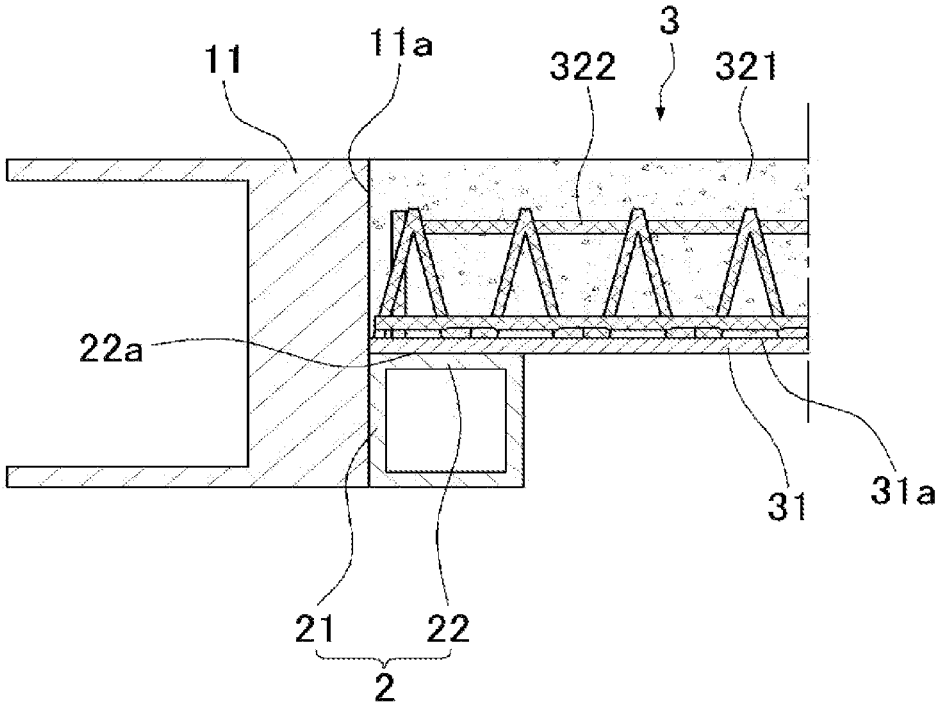
FIG. 4B is a partial cross-sectional view provided to describe another exemplary embodiment of a supporting unit.

FIG. 3A is a schematic cross-sectional view taken along a line A-A of FIG. 1, and FIG. 3B and FIG. 3C are cross-sectional views provided to describe another exemplary embodiment of lower side rails. Further, FIG. 4A is an enlarged conceptual diagram of a portion of FIG. 3A, and FIG. 4B is a partial cross-sectional view provided to describe another exemplary embodiment of a supporting unit.

The present container module for construction 100 may include a lower side rail 11, a lower end rail 12, and a lower corner casting 13.

The lower side rail 11 is a component constituting a lower long side among lower sides of the present container module for construction 100. Two lower side rails 11 may be provided. For reference, referring to FIG. 1, the lower sides may refer to sides of a square (lattice) shape formed by two lower side rails 11 and two lower end rails 12.

Referring to FIG. 1, the two lower side rails 11 may be arranged in parallel to each other with a space therebetween. Further, the lower side rail 11 may have a cross section of which at least one of two sides (two lateral surfaces) is opened. For example, referring to FIG. 3A and FIG. 3B, the lower side rail 11 may have a C-shaped cross section (a cross section of which one side is opened). In this case, referring to portions illustrated by a dotted line in FIG. 3A and FIG. 3B, the lower side rail 11 of the present container module for construction 100 can be easily fastened to an upper side rail 14 of another container module for construction (hereinafter, referred to as "lower container module for construction) arranged under the present container module for construction 100.

Particularly, as illustrated in FIG. 3B, if the lower side rail 11 has a C-shaped cross section of which the inner side of two sides is opened, referring to the portion illustrated by the dotted line in FIG. 3B, the conditions in an inner room of the lower container module for construction may allow a fastening operation such as bolting, welding, or the like. Thus, the container modules arranged in a vertical direction can be easily fastened to each other. Further, referring to the portion illustrated by the dotted line in FIG. 3B, an upper side rail 14 of the present container module for construction 100 may have a C-shaped cross section corresponding to the lower side rail 11.

As another example, referring to FIG. 3C, the lower side rail 11 may have a rectangular cross section such as a box-shaped cross section. Otherwise, the lower side rail 11 may have a side lying H-shaped cross-section (a cross section of which both sides are opened). However, the cross section of the lower side rail 11 is not limited thereto, and may be set to various shapes, such as a L-shaped cross section, an inverse L-shaped cross section, and a H-shaped cross section, if necessary, in terms of structural configuration (physical property), design (exterior), and the like.

The lower end rail 12 is a component constituting a lower short side among the lower sides. Two lower end rails 12 may be provided.

Referring to FIG. 1, the two lower end rails 12 may be arranged in parallel to each other with a space therebetween. Further, the lower end rail 12 may have a cross section of which at least one of two sides is opened (for example, a C-shaped cross section or a side lying H-shaped cross section) or a rectangular cross section such as a box-shaped cross section. However, the cross section of the lower end rail 12 is not limited thereto, and may be set to various shapes, such as a L-shaped cross section, an inverse L-shaped cross section, and a H-shaped cross section, if necessary, in terms of structural configuration (physical property), design (exterior), and the like.

The lower corner casting 13 is a component arranged at each corner between the lower sides. Four lower corner castings 13 may be provided. To be specific, referring to FIG. 1, the lower corner castings 13 may be respectively arranged at four corners of a square formed by the above-described four lower sides (including the two lower side rails 11 and the two lower end rails 12). For example, one of the lower corner castings 13 may be arranged to be in contact with one end of one of the lower side rails 11 and one end of one of the lower end rails 12. Further, the lower corner casting 13 may include multiple holes. The configuration of the lower corner casting 13 is obvious in relation to a shipping container (ISO freight container), and, thus, more detailed description thereof will be omitted.

Further, the present container module for construction 100 may include the upper side rail 14, an upper end rail 15, an upper corner casting 16, and a corner post 17.

The upper side rail 14 is a component constituting an upper long side among upper sides of the present container module for construction 100. Two upper side rails 14 may be provided. For reference, referring to FIG. 1, the upper sides may refer to sides of a square (lattice) shape formed by two upper side rails 14 and two upper end rails 15.

Referring to FIG. 1, the two upper side rails 14 may be arranged in parallel to each other with a space therebetween. Further, similarly to the lower side rail 11, the upper side rail 14 may have a cross section of which at least one of two sides is opened (for example, a C-shaped cross section or a side lying H-shaped cross section) or a rectangular cross section such as a box-shaped cross section. However, the cross section of the upper side rail 14 is not limited thereto, and may be set to various shapes, such as a L-shaped cross section, an inverse L-shaped cross section, and a H-shaped cross section, if necessary, in terms of structural configuration (physical property), design (exterior), and the like.

The upper end rail 15 is a component constituting an upper short side among the upper sides. Two upper end rails 15 may be provided.

Referring to FIG. 1, the two upper end rails 15 may be arranged in parallel to each other with a space therebetween. Further, the upper end rail 15 may have a cross section of which at least one of two sides is opened (for example, a C-shaped cross section or a side lying H-shaped cross section) or a rectangular cross section such as a box-shaped cross section. However, the cross section of the upper end rail 15 is not limited thereto, and may be set to various shapes, such as a L-shaped cross section, an inverse L-shaped cross section, and a H-shaped cross section, if necessary, in terms of structural configuration (physical property), design (exterior), and the like.

The upper corner casting 16 is a component arranged at each corner between the upper sides. Four upper corner castings 16 may be provided. To be specific, referring to FIG. 1, the upper corner castings 16 may be respectively arranged at four corners of a square formed by the above-described four upper sides (including the two upper side rails 14 and the two upper end rails 15). For example, one of the upper corner castings 16 may be arranged to be in contact with one end of one of the upper side rails 14 and one end of one of the upper end rails 15. Further, the upper corner casting 16 may include multiple holes. The configuration of the upper corner casting 16 is obvious in relation to a shipping container, and, thus, more detailed description thereof will be omitted.

Further, referring to FIG. 1, the corner post 17 is a component configured to connect the lower corner casting 13 and the upper corner casting 16. The configuration of the corner post 17 is obvious in relation to a shipping container, and, thus, more detailed description thereof will be omitted.

Further, it is desirable to perform a fireproofing treatment to the above-described components 11, 12, 13, 14, 15, 16, and 17 constituting a frame of the present container module for construction 100. For example, if a structure is required to satisfy the requirements for fireproof construction in Korea, it is necessary to perform a fireproofing treatment to all of main structural parts such as a frame as well as a slab part.

Furthermore, the present container module for construction 100 may include a supporting unit 2 and a slab part 3.

The supporting unit 2 is provided to be inwardly protruded from an inner surface 11*a* of each of the two lower side rails 11.

Referring to FIG. 4A and FIG. 4B, the supporting unit 2 may include a joining member 21 joined to the inner surface 11*a* of the lower side rail 11 and a protruding member 22 which is inwardly protruded from an upper end of the joining member 21 and of which a top surface serves as a supporting surface 22*a* supporting the slab part 3 (for example, a base part 31).

For example, as illustrated in FIG. 4A, the supporting unit 2 may have a L-shaped cross section. For example, the supporting unit 2 may be provided by attaching a L-shaped steel to the inner surface 11*a* of the lower side rail 11 along its longitudinal direction. To be specific, referring to FIG. 4A, the supporting unit 2 may be provided by turning a L-shaped steel upside down (in the form of an inverse L-shaped steel) to secure the supporting surface 22*a* supporting the base part 31.

However, the supporting unit 2 is not limited to the member having a L-shaped cross section. For example, referring to FIG. 4B, the supporting unit 2 may be a member having a box-shaped cross section. Otherwise, the supporting unit 2 may have various cross sections, such as a C-shaped cross section and a side lying H-shaped cross section, having the supporting surface 22*a* capable of supporting the slab part 3.

Both ends of the slab part 3 are supported by the supporting surfaces 22*a* of the supporting units 2 respectively provided at the two lower side rails 11. The slab part 3 may have a thickness satisfying the requirements for fireproof construction to be applied a floor slab of a structure including the container module for construction 100.

Meanwhile, referring to FIG. 3A, the slab part 3 may include the base part 31 and a reinforced concrete slab 32.

The base part 31 includes a base plate of which both ends are supported by the supporting surfaces 22*a* of the supporting units 2 respectively provided at the two lower side rails 11.

Figure 5A:
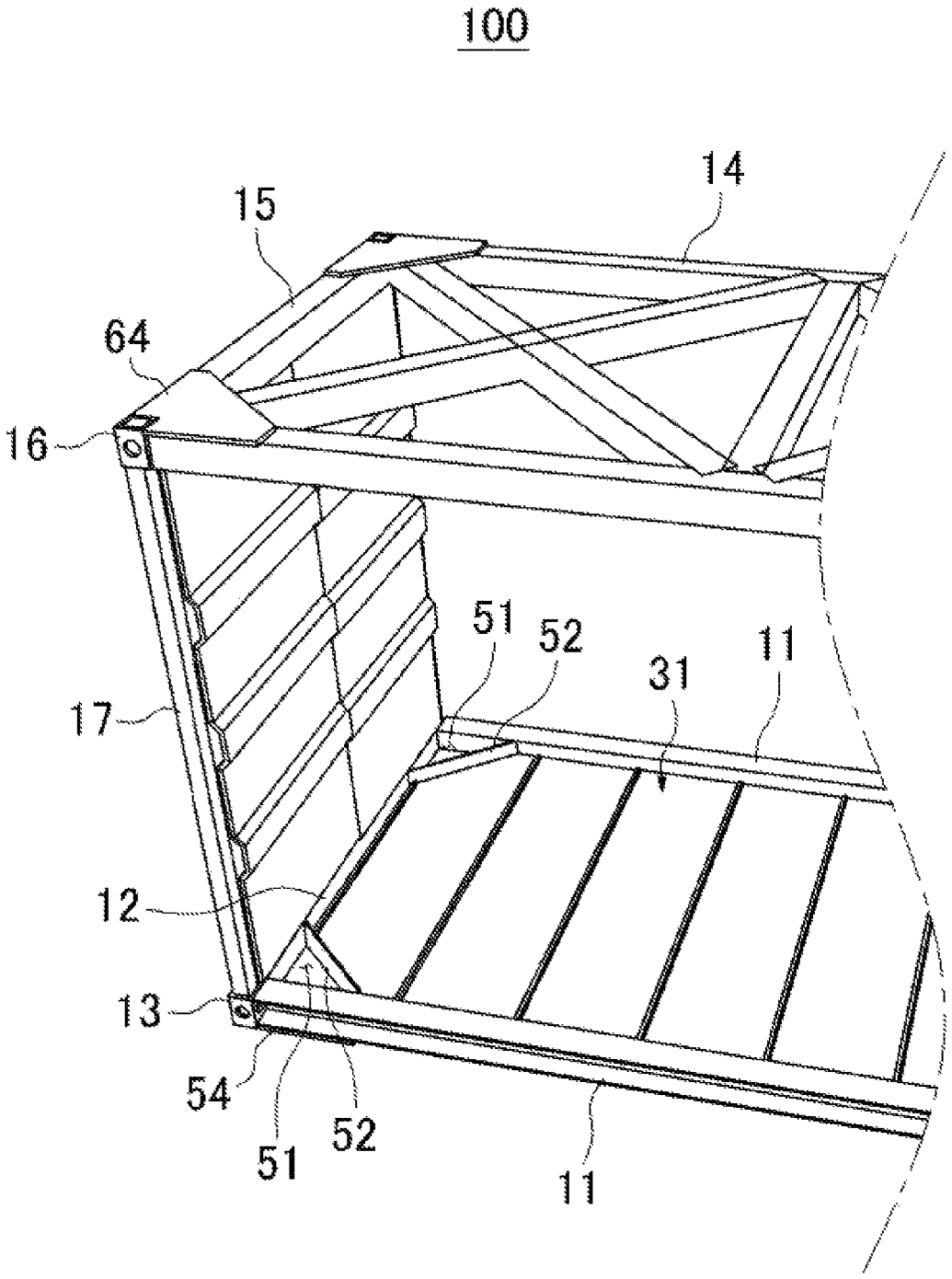
FIGS. 5A, 5B, 5C and FIG. 5D are schematic three-dimensional diagrams provided to gradationally describe a process for preparing a fireproof floor slab in a container module for construction having a fireproof floor slab in accordance with an example of the present disclosure.
Figure 5B:
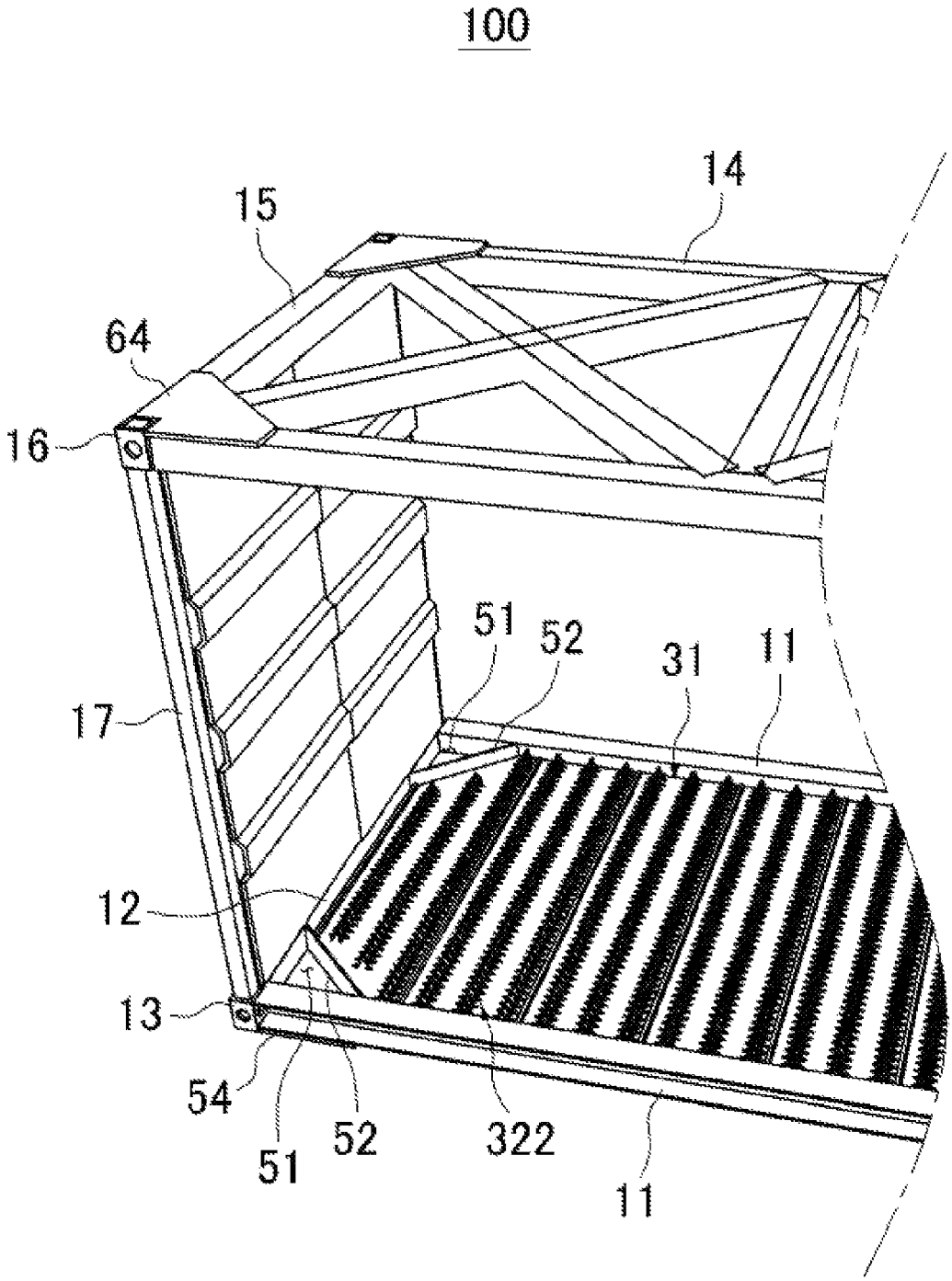
Figure 5C:
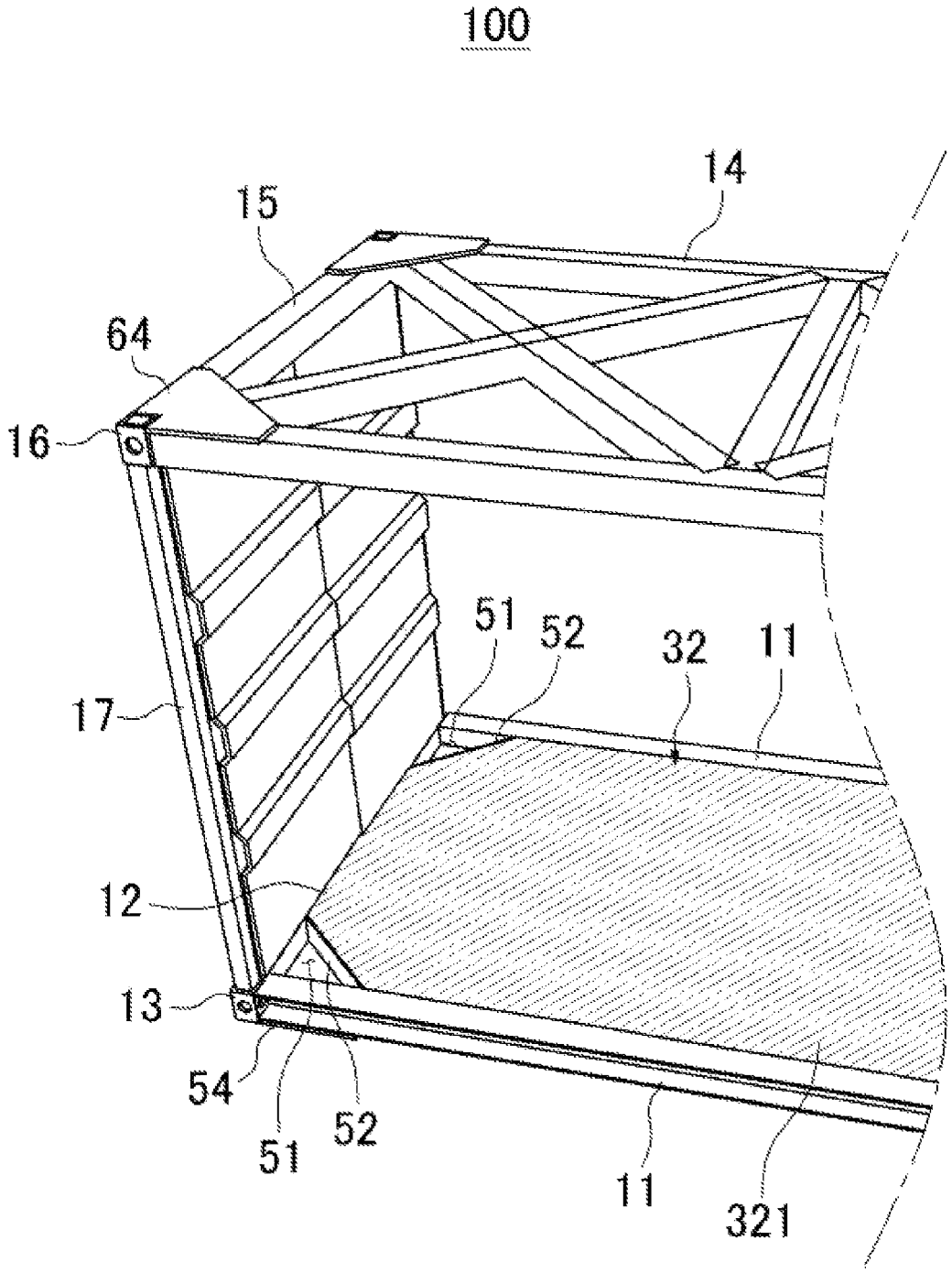
Figure 5D:
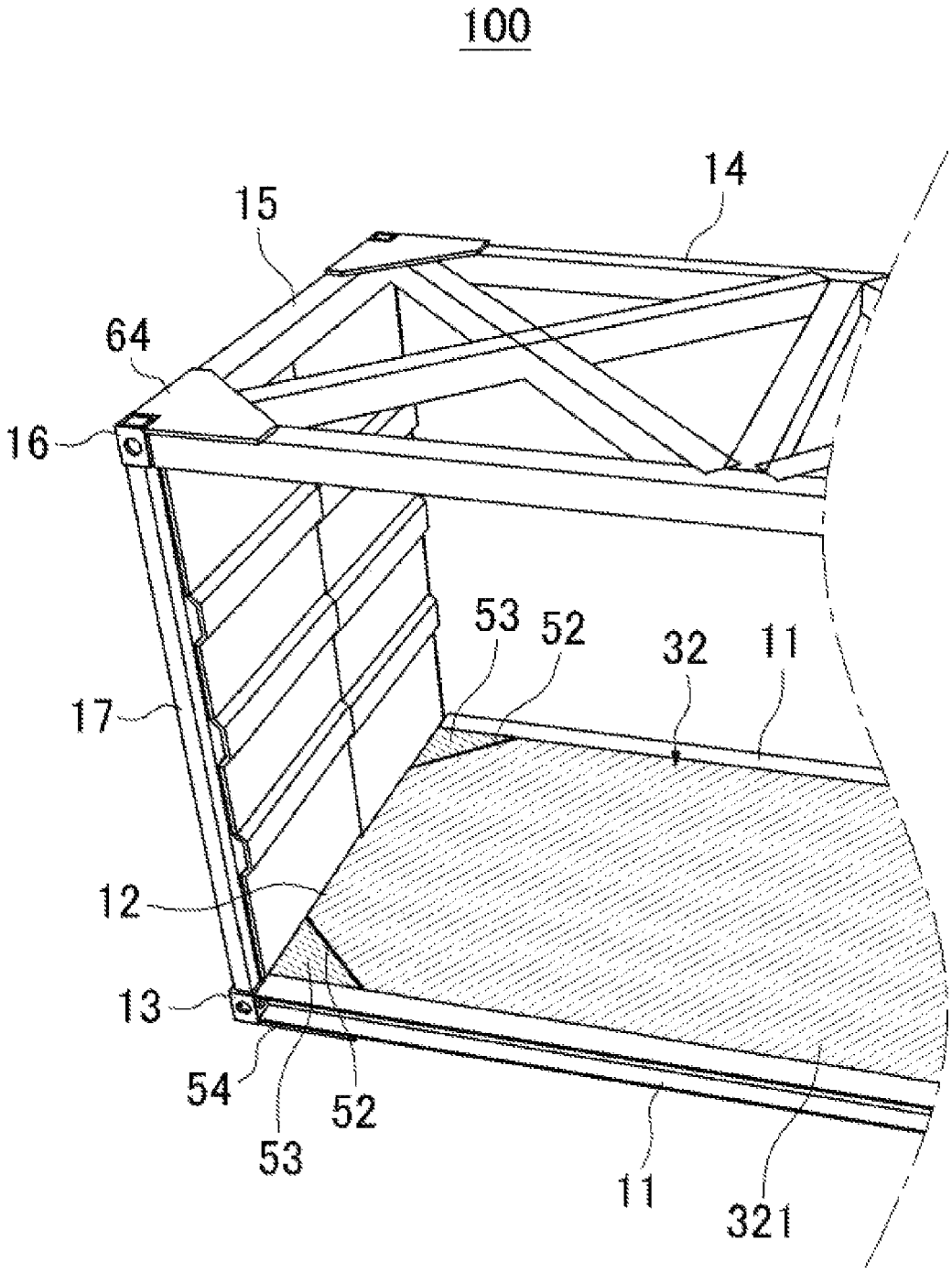
Figure 6:
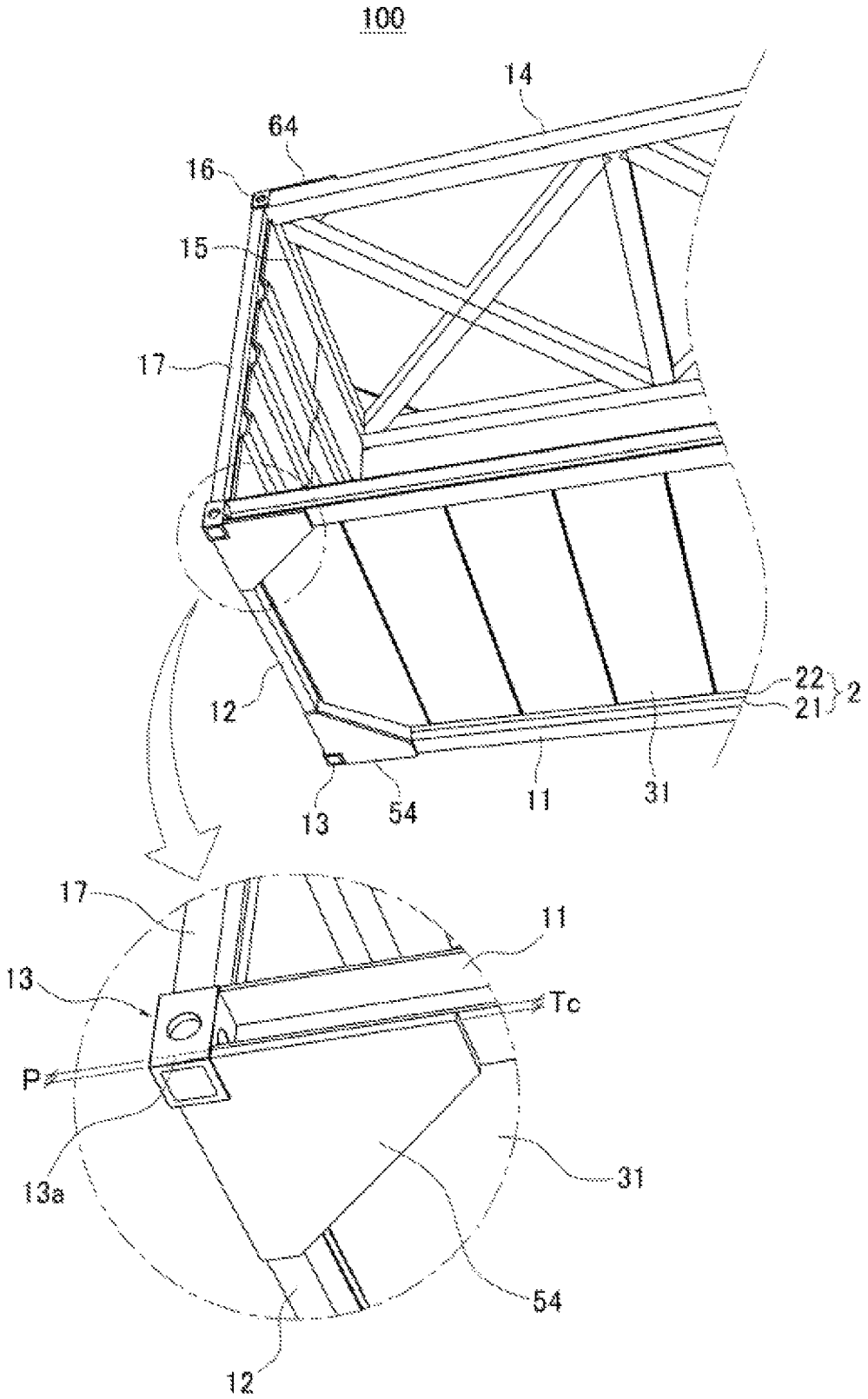
FIG. 6 is a schematic three-dimensional diagram provided to describe a lower corner member of a container module for construction having a fireproof floor slab in accordance with an example of the present disclosure.

FIG. 5A to FIG. 5D are schematic three-dimensional diagrams provided to gradationally describe a process for preparing a fireproof floor slab in a container module for construction having a fireproof floor slab in accordance with an example of the present disclosure, and FIG. 6 is a schematic three-dimensional diagram provided to describe a lower corner member of a container module for construction having a fireproof floor slab in accordance with an example of the present disclosure.

Referring to FIG. 5A and FIG. 6, the base part 31 may include multiple base plates which are arranged in parallel to each other and of which both ends are supported by the two supporting units 2. The base plate may be referred to as a deck plate. For example, at least one portion of the deck plate may have a flat plate shape (for example, all but portions engaged with and fastened to other deck plates have a flat plate shape). However, the deck plate is not limited to such a flat deck. As another example, the deck plate may be a corrugated plate (corrugated deck) such as a corrugated steel plate. Further, although not clearly illustrated in the drawings, each of the multiple base plates is engaged with and fastened to its adjacent base plates. Thus, the base part 31 may have a stronger interconnection structure.

The reinforced concrete slab 32 is formed on the base part 31 as being integrated with the base part 31.

The reinforced concrete slab 32 may be integrated with the base part 31 by placing and curing concrete 321 on the base part 31. Through a curing process of the concrete 321, the concrete 321 included in the reinforced concrete slab 32 can be hardened as being in contact with a top surface 31*a* of the base part 31. That is, by hardening the concrete through a curing process, the concrete 321 included in the reinforced concrete slab 32 can be attached and bonded to the top surface 31*a* of the base part 31.

Herein, the term "attached and bonded" may mean that the concrete 321 included in the reinforced concrete slab 32 is hardened as being in contact with particles in the top surface 31*a* of the base part 31. Through the attachment and bonding, the reinforced concrete slab 32 can be fixed to the top surface 31*a* of the base part 31 as a unit.

Referring to FIG. 1, FIG. 3A to FIG. 3B, and FIG. 5A, the two lower side rails 11 and the two lower end rails 12 may be configured to surround the base part 31. Accordingly, the inner surfaces 11*a* of the two lower side rails 11, inner surfaces of the two end rails 12, and the top surface 31*a* of the base part 31 may serve as a cast corresponding to a shape of the reinforced concrete slab 32.

The lower rails 11 and 12 may be used as lateral surfaces of the cast and the base part 31 may be used as a bottom surface of the cast in placing and curing the concrete 321 constituting the reinforced concrete slab 32. Therefore, the use of a separate cast is not needed or can be minimized. Further, high constructability can be secured.

Further, according to the present disclosure, the reinforced concrete slab 32 is formed as a unit on the base part 31 supported by the supporting units 2 provided on the inner surfaces 11*a* of the lower side rails 11, and, thus, the reinforced concrete slab 32 as a fireproof construction can be arranged to use an inner space surrounded by the lower side rails 11 and the lower end rails 12 without reducing an inner room of the container module as much as possible. Therefore, the present container module for construction 100 makes it possible to easily obtain fireproof efficiency satisfying the fireproof standards without additional work for obtaining fireproof certification in a construction site.

That is, according to the present disclosure, a fireproof construction designed to be customized for a frame of a standardized shipping container module or a slightly modified container module makes it possible to maximize application of the inner room of the container module.

Further, the reinforced concrete slab 32 may have a thickness satisfying the requirements for fireproof construction to be applied a floor slab of a structure including the container module for construction 100.

For example, if a structure is constructed in Korea, a main structural part of a structure to be used for cultural/assembly facility with a total floor area of 200 $m^2$, a structure to be used for gymnasium/playground with a total floor area of 500 $m^2$, a structure to be used for factory with a total floor area of 2000 $m^2$, a structure to be used for multi-family house/multi-unit house with a total floor area of 400 $m^2$, a structure with three or more floors, or a structure with underground floors is required to be of a fireproof construction according to Article 56 of the Enforcement Decree of the Korean Building Act (as partially revised on Nov. 28, 2014).

Further, according to Article 3 of the Korean Regulation on Fire Escaping/Protection Construction of Building (as partially revised on Nov. 28, 2014), it is prescribed that a floor which is a reinforced concrete structure or a steel framed reinforced concrete structure and has a thickness of 10 cm or more satisfies the requirements for fireproof construction.

Accordingly, the thickness satisfying the requirements for fireproof construction may be a thickness of a reinforced concrete slab satisfying the standards set in a country where the structure is constructed, or a thickness of a reinforced concrete slab of 10 cm or more.

Further, referring to FIG. 4A, an over-all height H of the lower side rail 11 and a location a of the supporting surface 22*a* may be set in order for the slab part 3 to have a thickness Ts+Tb which is equal to or less than a height value H−a from the supporting surface 22*a* of the supporting unit 2 to the uppermost end of the lower side rail 11. In view of the reinforced concrete slab 32 as a subcomponent of the slab part 3, the over-all height H of the lower side rail 11 and the location a of the supporting surface 22*a* may be set in order for the reinforced concrete slab 32 to have a thickness Ts which is equal to or less than a height value H−a−Tb from the top surface 31*a* of the base part 31 to the uppermost end of the lower side rail 11.

In other words, the sizes and the locations of the lower side rail 11, the supporting unit 2, and the base part 31 may be set in order for the reinforced concrete slab 32 to have a thickness satisfying the requirements for fireproof construction and in order for a top surface of the reinforced concrete slab 32 not to be protruded above the uppermost end of the lower side rail 11. The base part 31 may be provided as a relatively thin steel plate (for example, 0.5 t galvanized sheet iron). Therefore, the sizes and the locations of the lower side rail 11 and the supporting unit 2 are mainly adjusted in order for the top surface of the reinforced concrete slab 32 to be located under the uppermost end of the lower side rail 11. Further, the uppermost end of the lower end rail 12 may be located at the same height or above the uppermost end of the lower side rail 11.

By setting a thickness as such (H−a≥Ts+Tb), the top surface of the reinforced concrete slab 32 may be located at the same height or below the uppermost end of the lower side rail 11. Therefore, a fireproof construction can be constructed without invading an inner room of a container module. Further, the top surface of the reinforced concrete slab 32 may be formed below the uppermost end of the lower side rail 11 and the uppermost end of the lower end rail 12 while satisfying the requirements for fireproof construction. Therefore, the lower side rails 11 and the lower end rails 12 may serve as lateral surfaces of the cast, and, thus, it is possible to readily place and cure the concrete 321 for forming the reinforced concrete slab 32 without addition of a separate cast.

Furthermore, the reinforced concrete slab 32 may have an upper covering thickness (effective thickness of upper concrete) of 2 cm or more. Considering that a minimum height of a rebar 322 arranged in a floor slab is about 8 cm in a general structure, the thickness Ts of the reinforced concrete slab 32 may be desirably 10 cm or more and may be set to about 12 cm in view of securing a sufficient upper covering thickness.

Further, referring to FIG. 4, the rebar 322 arranged inside the reinforced concrete slab 32 may be arranged according to a rebar arrangement method applied to a general floor slab. For example, the rebar 322 may include an upper main rebar, an upper distribution bar, a lower main rebar, a lattice (a triangular truss-type member in FIG. 4), and the like. A diameter and an interval of the rebar 322 may be set in various ways for structural configuration considering physical properties according to the standards of the present container module for construction 100.

Further, the present container module for construction 100 may include a partition member 52.

Referring to FIG. 5A, the partition member 52 is a component configured to connect the lower side rails 11 and the lower end rails 12 to make a predetermined lower corner room 51 near the lower corner castings 13.

Further, referring to FIG. 6, FIG. 5A, and FIG. 5C, the supporting unit 2, the base part 31, and the reinforced concrete slab 32 may be formed within a region surrounded by the two lower side rails 11, the two lower end rails 12, and the partition member 52. In particular, referring to FIG. 5C, since the reinforced concrete slab 32 is formed within a region surrounded by the two lower side rails 11, the two lower end rails 12, and the partition member 52, the lower corner room 51 may be formed in a direction from the partition member 52 toward the lower corner casting 13. For example, as illustrated in FIG. 5C, the lower corner room 51 may be formed into a triangular prism shape.

Further, the present container module for construction 100 may include a lower corner member 54.

Referring to FIG. 6, the lower corner member 54 may constitute a floor surface of the lower corner room 51 as being attached to a bottom surface of the lower side rail 11 and a bottom surface of the lower end rail 12.

Further, referring to an enlarged portion of FIG. 6, the lower corner casting 13 may include a downward protrusion part 13*a* protruded below the lower side rails 11 and the lower end rails 12. The lower corner member 54 may be provided as covering the downward protrusion part 13*a*.

Furthermore, the lower corner member 54 may have a thickness Tc corresponding to a protrusion amount P of the downward protrusion part 13*a*. In a general shipping container (ISO freight container), a lower corner casting has a greater size than a lower side rail or a lower end rail and is protruded below the lower side rail or the lower end rail.

That is, the present inventors conceived that a container has a general characteristic that the lower corner casting 13 is further protruded below its neighboring members 11 and 12 and designed the lower corner member 54 having the thickness Tc substantially equal to the protrusion amount P of the downward protrusion part 13*a* to cover the downward protrusion part 13*a*.

Accordingly, the lower corner member 54 may be connected to an upper corner member 64 attached to a top surface of the upper side rail 14 and a top surface of the upper end rail 15 of the lower container module for construction. Herein, similarly to the lower corner member 54, the upper corner member 64 may have a thickness substantially equal to a protrusion amount of an upward protrusion part of the upper corner casting 16 and may be provided to cover the upward protrusion part.

To be specific, for example, if the present container module for construction 100 is stacked on the lower container module for construction, the lower corner casting 13 of the present container module for construction 100 is in contact with the upper corner casting 16 of the lower container module for construction. In this case, the lower corner member 54 having the thickness Tc corresponding to the downward protrusion part 13*a* of the lower corner casting 13 is also in contact with the upper corner member 64. Thus, the lower corner member 54 can be more easily connected to the upper corner member 64.

By connecting the lower corner member 54 to the upper corner member 64 as such, multiple container modules for construction 100 can be stacked.

For example, the lower corner member 54 may be connected to the upper corner member 64 by, but not limited to, welding, bolting, or the like. To be more specific, the lower corner room 51 makes it possible more easily perform an operation such as bolting or welding for connecting the lower corner member 54 to the upper corner member 64 located under the lower corner member 54. As another example, if the lower side rail 11 has a C-shaped cross section (see FIG. 3A and FIG. 3B), its open side makes it possible to perform an operation such as bolting of the lower corner member 54 to the upper corner member 64.

Particularly, as illustrated in FIG. 3B, if the lower side rail 11 has a C-shaped cross section of which the inner side of two sides is opened, referring to the portion illustrated by the dotted line in FIG. 3B, the conditions in an inner room of the lower container module for construction may allow a fastening operation such as bolting, welding, or the like. Thus, the container modules arranged in a vertical direction can be easily fastened to each other. Referring to the portion illustrated by the dotted line in FIG. 3B, an upper side rail 14 of the present container module for construction 100 may have a C-shaped cross section corresponding to the lower side rail 11.

Further, the lower corner member 54 to the upper corner member 64 may include multiple holes for bolting, welding, or the like in order to facilitate such a connection operation.

Furthermore, a filling part 53 filled with cement mortar or cement milk may be formed in the lower corner room 51 on the lower corner member 54. As described above, the lower corner room 51 may be used as a working space for vertically connecting (stacking) the multiple present container modules for construction 100. When an operation for connecting the lower corner member 54 to the upper corner member 64 is ended, the lower corner room 51 may be filled with cement mortar or cement milk in order to satisfy the requirements for fireproof construction (see FIG. 5D).

Hereinafter, a process for forming the slab part 3 will be described with reference to FIG. 5A to FIG. 5D and FIG. 6.

Firstly, referring to FIG. 5A and FIG. 6, the base part 31 may be arranged such that both ends of the base plate are supported on the supporting units 2.

Then, referring to FIG. 5B, the rebar 322 may be arranged on the base part 31. In this case, a direction of the lower short side may be a direction of the main rebar.

Then, referring to FIG. 5C, the concrete 321 may be placed and cured on the base part 31 on which the rebar 322 is already arranged. In this case, it is desirable to set the sizes and locations of the lower rails 11 and 12 and the supporting unit 2 such that a placing surface of the concrete 321 can be located at the same height or below the uppermost end of the lower side rail 11 and the uppermost end of the lower end rail 12 and the concrete 321 can be placed to a thickness satisfying the requirements for fireproof construction.

Further, the structure 1000 can be constructed using the present container module for construction 100 in a state (in which the lower corner room 51 secured by the partition member 52 is not yet filled) as illustrated in FIG. 5C. For example, as described above, the present container module for construction 100 may be stacked on the lower container module for construction. In this case, the lower corner member 54 of the present container module for construction 100 can be more easily connected to the upper corner member 64 of the lower container module for construction through the lower corner room 51 which is not yet filled.

Then, referring to FIG. 5D, when the use of the lower corner room 51 is completed, the lower corner room 51 is filled with cement mortar or cement milk, so the entire floor slab of present container module for construction 100 has a thickness satisfying the requirements for fireproof construction.

Meanwhile, the structure 1000 in accordance with an example of the present disclosure (hereinafter, referred to as "present structure") includes the above-described present container module for construction 100. Referring to FIG. 2, the present structure 1000 may include multiple present container modules for construction 100.

Further, each of the multiple present container modules for construction 100 may have a different size considering its location, structural properties, and a design of its inner space. That is, the multiple present container modules for construction 100 are not limited to being of the same type, and may be of various types different from each other in size if necessary.

The above description of the example embodiments is provided for the purpose of illustration, and it would be understood by those skilled in the art that various changes and modifications may be made without changing technical conception and essential features of the example embodiments. Thus, it is clear that the above-described example embodiments are illustrative in all aspects and do not limit the present disclosure. For example, each component described to be of a single type can be implemented in a distributed manner. Likewise, components described to be distributed can be implemented in a combined manner.

The scope of the inventive concept is defined by the following claims and their equivalents rather than by the detailed description of the illustrative embodiments. It shall be understood that all modifications and embodiments conceived from the meaning and scope of the claims and their equivalents are included in the scope of the inventive concept.

EXPLANATION OF CODES

100: Container module for construction
11: Lower side rail
11*a*: Inner surface of lower side rail
12: Lower end rail
13: Lower corner casting
13*a*: Downward protrusion part
14: Upper side rail
15: Upper end rail
16: Upper corner casting
17: Corner post
2: Supporting unit
21: Joining member
22: Protruding member
22*a*: Supporting surface
3: Slab part
31: Base part
31*a*: Top surface of base part
32: Reinforced concrete slab
321: Concrete
322: Rebar
51: Lower corner room
52: Partition member
53: Filling part
54: Lower corner member
64: Upper corner member
1000: Structure

We claim:

1. A container module for construction having a floor slab, comprising:

two lower side rails that constitute lower long sides among lower sides of the container module for construction;

two lower end rails that constitute lower short sides among the lower sides;

four lower corner castings respectively arranged at corners between adjacent lower side rails and lower end rails;

two supporting units, wherein each supporting unit is provided to be inwardly protruding from an inner surface of a respective lower side rail;

a slab part, wherein the slab part is at least partially supported by a supporting surface of each of the supporting units respectively provided at the two lower side rails, and four partition members, wherein each partition member is configured to connect a respective one of the lower side rails and a respective one of the lower end rails to make a predetermined lower corner room near a respective lower corner casting, wherein the two supporting units, a base part, and a reinforced concrete slab are formed within a region surrounded by the two lower side rails, the two lower end rails, and the four partition members.

2. The container module for construction having a floor slab of claim 1, wherein the slab part has a pre-determined thickness, and further wherein an over-all height of each lower side rail and a location of each supporting surface are set such that the slab part has a thickness which is equal to or less than a height value from the supporting surface of each supporting unit to an uppermost end of each lower side rail.

3. The container module for construction having a floor slab of claim 2, wherein the thickness of the reinforced concrete slab is 10 cm or more.

4. The container module for construction having a floor slab of claim 3, wherein the reinforced concrete slab has an upper covering thickness of 2 cm or more, wherein the upper covering thickness extends above a rebar arranged within the reinforced concrete slab.

5. The container module for construction having a floor slab of claim 1, wherein the slab part comprises:

the base part, wherein the base plate includes a base plate having ends supported by the supporting surfaces of the two supporting units; and wherein the reinforced concrete slab is formed on the base part and is integrated with the base part.

6. The container module for construction having a floor slab of claim 5, wherein concrete included in the reinforced concrete slab is attached and bonded to a top surface of the base part.

7. The container module for construction having a floor slab of claim 5, wherein concrete included in the reinforced concrete slab is hardened and is in contact with a top surface of the base part.

8. The container module for construction having a floor slab of claim 5, wherein the two lower side rails and the two lower end rails surround the base part, and the inner surfaces of the two lower side rails, inner surfaces of the two lower end rails, and a top surface of the base part serve as a cast corresponding to a shape of the reinforced concrete slab.

9. The container module for construction having a floor slab of claim 1, further comprising:

four lower corner members, wherein each lower corner member constitutes a floor surface of a respective lower corner room and is coupled to a bottom surface of a respective lower side rail and a bottom surface of a respective lower end ran.

10. The container module for construction having a floor slab of claim 9, wherein each lower corner casting includes a downward protrusion part protruded below a respective lower side rail and a respective lower end rail, and further wherein each respective lower corner member has a thickness corresponding to a protrusion amount of the downward protrusion part and covers the downward protrusion part.

11. The container module for construction having a floor slab of claim 10, wherein each lower corner member is configured to be couplable to a corresponding upper corner member attached to a top surface of an upper side rail and a top surface of an upper end rail of another container module for construction arranged under the container module for construction.

12. The container module for construction having a floor slab of claim 9, wherein a filling part filled with cement mortar or cement milk is formed in each lower corner room.

13. The container module for construction having a floor slab of claim 1, wherein each supporting unit comprises:

a joining member joined to the inner surface of a respective lower side rail;

and a protruding member which is inwardly protruding from an upper end of the joining member and of which a top surface serves as the supporting surface supporting the base part.

14. A structure comprising:

a container module for construction having a floor slab according to claim 1.

* * * * *